US006590540B1

(12) United States Patent
Adams et al.

(10) Patent No.: US 6,590,540 B1
(45) Date of Patent: Jul. 8, 2003

(54) ULTRA-BROADBAND ANTENNA INCORPORATED INTO A GARMENT

(75) Inventors: Richard C. Adams, San Diego, CA (US); Robert S. Abramo, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/061,639

(22) Filed: Jan. 31, 2002

(51) Int. Cl.[7] ..... H01Q 1/12
(52) U.S. Cl. ..... 343/718; 343/897
(58) Field of Search ..... 343/700 MS, 718, 343/897; H01R 1/12

(56) References Cited

U.S. PATENT DOCUMENTS 4,041,394 A * 8/1977 Pate ..... 325/102
5,148,002 A * 9/1992 Kuo et al. ..... 219/211
6,356,238 B1 * 3/2002 Gainor et al. ..... 343/718
6,377,216 B1 * 4/2002 Cheadle et al. ..... 343/700 MS
6,433,743 B1 * 8/2002 Massey et al. ..... 343/700 MS
6,483,469 B2 * 11/2002 Boyle ..... 343/718

* cited by examiner

*Primary Examiner*—Tho Phan
(74) *Attorney, Agent, or Firm*—Celia C. Dunham; Michael A. Kagan; James A. Ward

(57) ABSTRACT

An ultra-broadband antenna is incorporated into an electrically nonconductive garment. The antenna includes first and second RF elements attached to the garment so that a gap exists between them, where the RF elements each form a band when the garment is worn by a wearer. RF and ground feeds are electrically connected to the first and second RF elements, respectively. A shorting strap electrically connected between the first and second RF elements on the anterior side of the garment generally opposite the feeds helps match the antenna impedance to an external signal source. A gap between the RF elements provides a voltage difference between the RF elements when the antenna is energized. Electrically conductive straps are electrically connected between the anterior and dorsal regions of the first RF element that extend over the shoulder region of the garment. An impedance matching circuit electrically connected between the first RF element and the RF feed is used to match the impedance of the antenna with an external device for a particular operating bandwidth. The garment may be a vest or pullover garment suitable for being worn on a human torso.

10 Claims, 9 Drawing Sheets

ULTRA-BROADBAND ANTENNA INCORPORATED INTO A GARMENT

BACKGROUND OF THE INVENTION

The present invention generally relates to antennas, and more particularly, to an ultra-broadband antenna that is incorporated into a garment that may be worn around a human torso.

Most antennas of hand-held radios used by soldiers for tactical operations are monopoles or dipoles that extend from-a radio carried by the soldier. Such antennas have many disadvantages. For example, monopole antennas are narrowband and provide efficient operation over only a small frequency range. However, soldiers today have a need to communicate many different types of information which may include global positioning information, voice signals, and technical data. Each type of communication generally requires a separate frequency band. Thus, it may be appreciated that collectively, a soldier needs to have wideband communication capabilities. Monopole antennas do not provide such broadband operating capability. Also, monopole antennas are clumsy and tend to snag on trees, brush and low ceilings. Most importantly, the monopole antennas provide a visible signature that distinguishes the radio operator and any accompanying officer nearby, making them vulnerable to sniper fire. Because disruption of command, communications, and control is a paramount goal of snipers, reduction of the visual signature of an antenna is highly desirable.

Therefore, a need exists for a broadband, man-carried antenna that does not have a readily identifiable visual signature.

SUMMARY OF THE INVENTION

The present invention is directed to an ultra-broadband antenna that is incorporated into an electrically nonconductive garment. The antenna includes first and second radio frequency (RF) elements attached to the garment so that a gap exists between them, where the RF elements each form a band when the garment is worn by a wearer. RF and ground feeds are electrically connected to the first and second RF elements, respectively. A shorting strap electrically connected between the first and second RF elements on the anterior side of the garment generally opposite the feeds helps match the antenna impedance to an external device, such as a signal generator. The gap provides a voltage difference between the RF elements when the antenna is energized. Electrically conductive straps that extend over the shoulder regions of the garment are electrically connected between the anterior and dorsal regions of the first RF element. An impedance matching circuit electrically connected between the first RF element and the RF feed may be employed to approximately match the impedance of the antenna with an external device and the wearer to optimize the efficiency of the antenna for a particular operating band. The garment may be a vest or a pull-over type garment suitable for being worn on a human torso.

These and other advantages of the invention will become more apparent upon review of the accompanying drawings and specification, including the claims.

BRIEF DESCRIPTION OF THE DRAWINGS

Throughout the several views, like elements are referenced using like references.

DESCRIPTION OF THE PREFERRED EMBODIMENT

Figure 1:
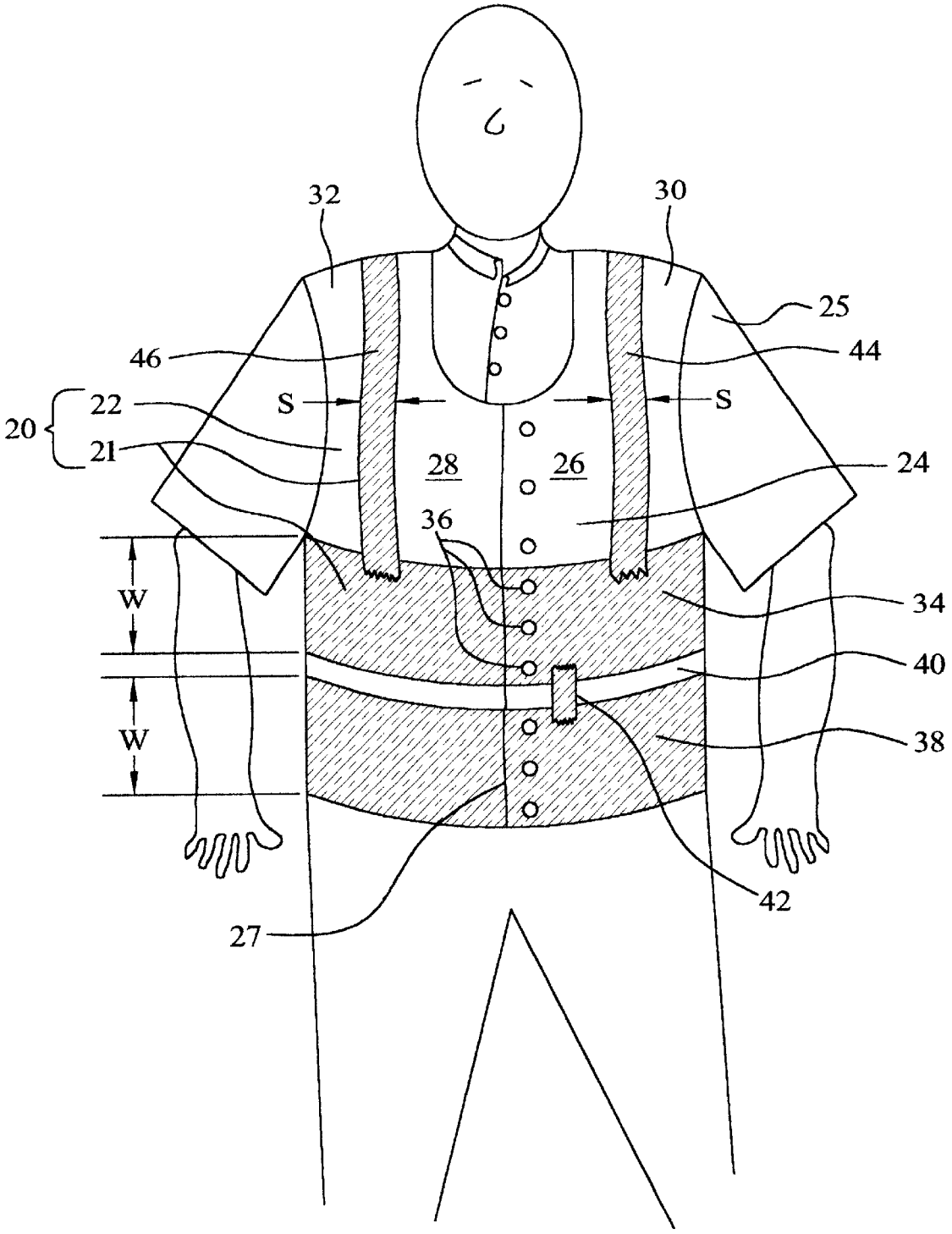
FIG. 1 illustrates an anterior view of a wide band antenna incorporated into a garment as shown worn by a wearer.
Figure 2:
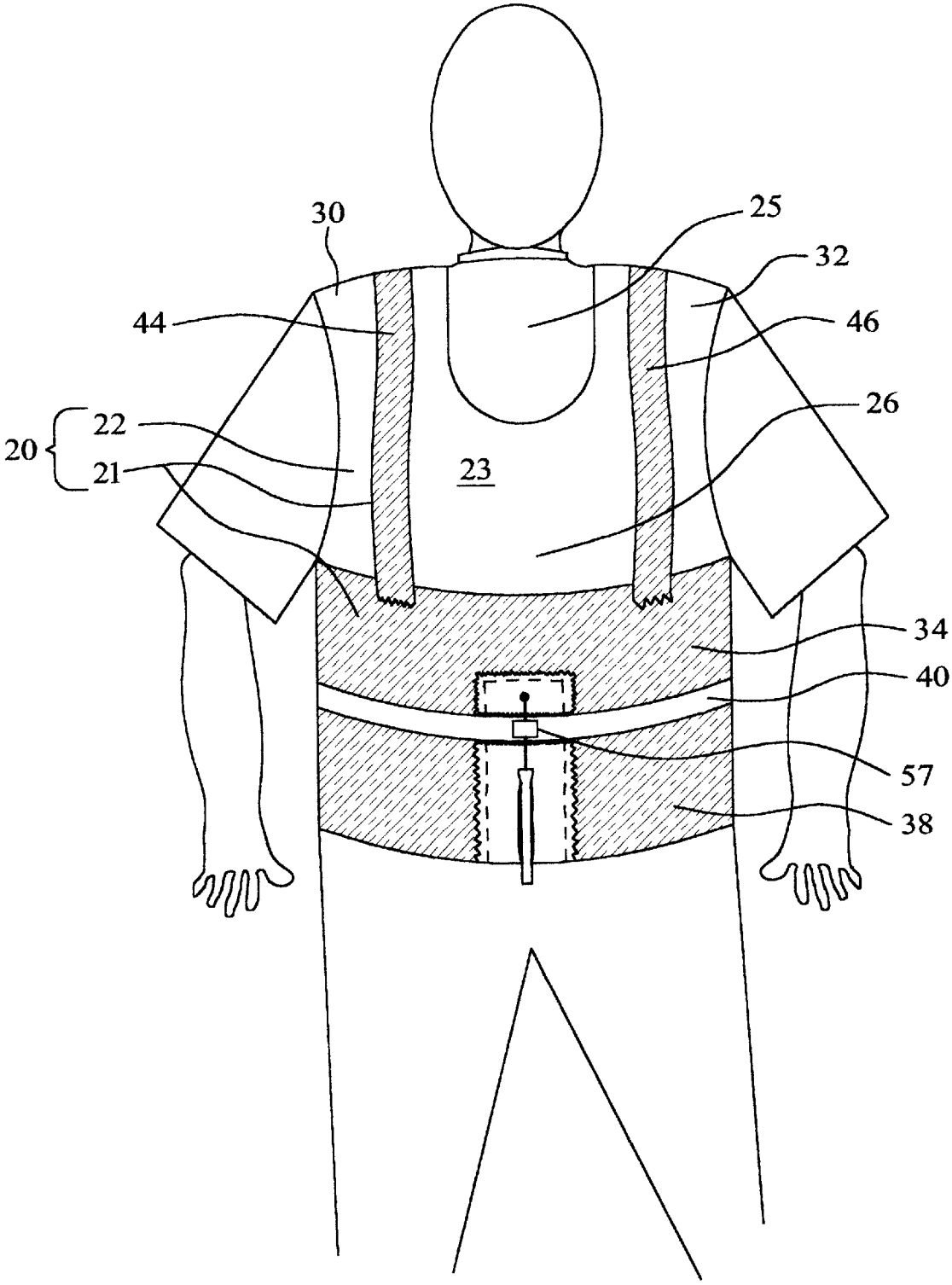
FIG. 2 shows a dorsal view of the antenna garment shown in FIG. 1.
Figure 3:
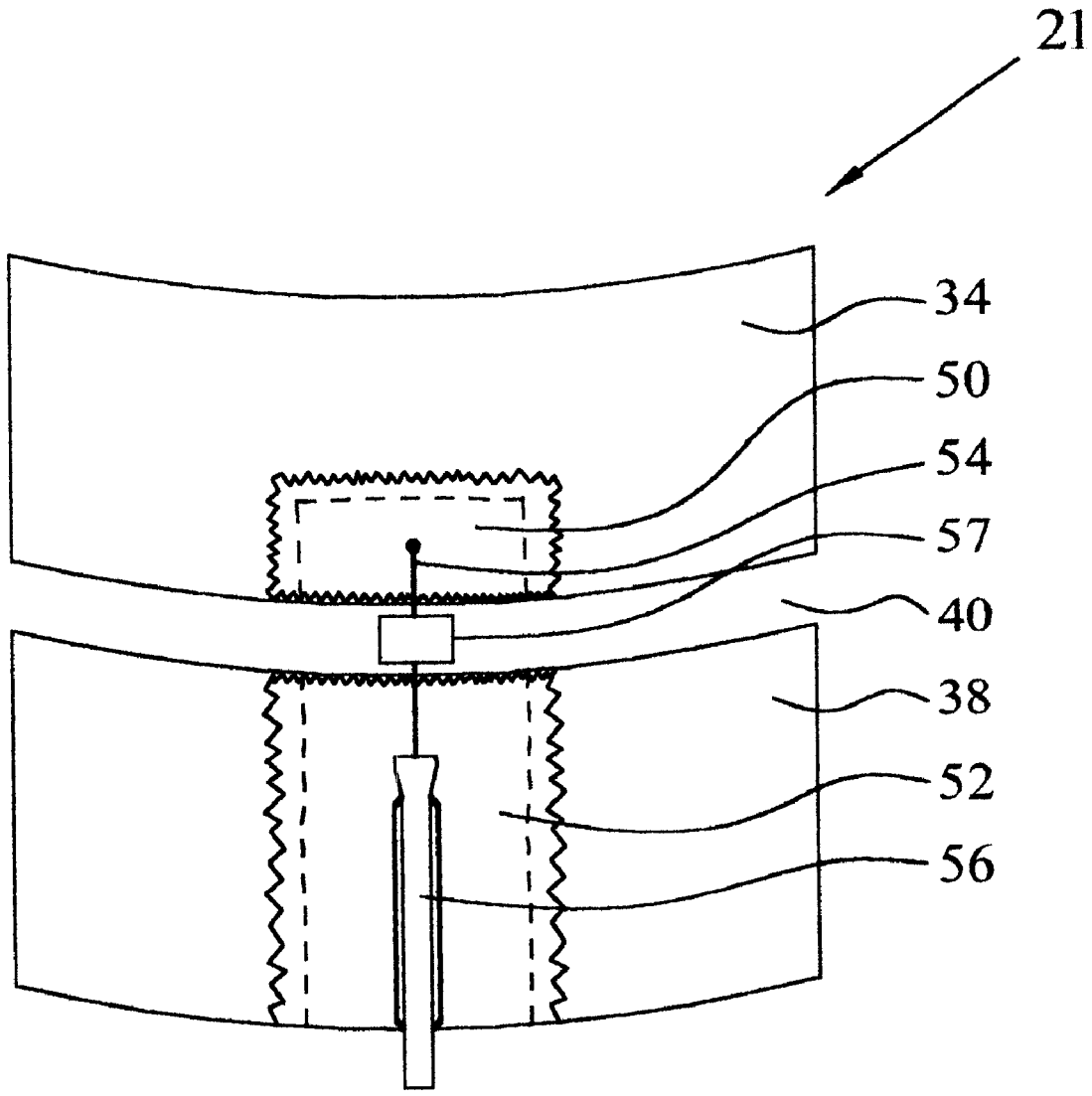
FIG. 3 shows RF energy input and ground connections to the antenna garment.

Referring to FIGS. 1, 2, and 3 collectively, there is shown an antenna garment 20 that includes an ultra-broadband antenna 21 integrated into a garment 22 that is worn by a human wearer 25. The antenna 21 operates very efficiently over a frequency range of about 35–500 MHz. Antenna 21 is integrated into the garment 22 so that the antenna 21 offers no distinctive visual signature that would identify the person wearing the antenna garment 20 as a radio operator. Garment 22 is made of an electrically nonconductive material such as a woven fabric selected from the group that includes cotton, wool, polyester, nylon, kevlar, rayon, and the like. Garment 22 has an anterior or front section 24 and a dorsal or back region 23. From the perspective of the human wearer 25, front section 24 of garment 22 includes a left anterior front section 26 and a right anterior front section 28. Garment 22 also has a left shoulder section 30 and a right shoulder section 32. Antenna 21 includes a first radio frequency (RF) element 34, a second RF element 38, a shorting strap 42, left shoulder strap 44, right shoulder strap 46, RF feed 54, ground feed 56, and impedance matching circuit 57, all of which are attached to the garment 22.

First and second RF elements 34 and 38 are attached to garment 22, as for example, by being sewn, bonded, or riveted. Each of RF elements 34 and 38 forms a band shaped ring when garment 22 is worn by wearer 25 and the front section 24 of the garment is fastened together by electrically conductive metal snaps 36 that electrically connect the ends of RF elements 34 and 38 in the vicinity of junction 27 so that the RF elements form an electrically conductive band. In one implementation of antenna 21, offered by way of example only, the widths, W of RF elements 34 and 38 were in the range of about 20–22 cm. However, it is to be understood that the scope of the invention includes widths of RF elements 34 and 38 that may fall outside the above-referenced range, as may be required to suit the needs of a particular application. An RF element is a structure for propagating and/or directing radio frequency energy. RF elements 34 and 38 are attached to garment 22 so that the RF elements are separated by a gap 40, having a distance D.

Generally, D≦2.5 cm, although the scope of the invention includes the distance D being greater than 2.5 cm as may be required to suit the requirements of a particular application. Gap 40 creates a voltage difference between RF of elements 34 and 38 when antenna 21 is excited with RF energy.

Antenna 21 further includes a first shorting strap 42 that electrically connects first and second RF elements 34 and 38, respectively, which are attached to garment 22, as for example, by being sewn, bonded, or riveted. The shorting strap 42 also overlaps and is sewn to RF elements 34 and 38 in order to provide excellent electrical conductivity between RF elements 34 and 38. The shorting strap 42 is used to improve the efficiency of antenna 21 at higher frequencies, as for example, in the range of about 100--500 MHz. A first or left shoulder strap 44 is electrically connected to first RF element 34 such that left strap 44 extends from the anterior region 26 to the dorsal region 23 of garment 22 over left shoulder region 30. To provide symmetry between the right and left sides of antenna garment 20, a second or right shoulder strap 46 is electrically connected to first RF element 34 such that right strap 46 extends from the anterior region 28 to the dorsal region 23 of garment 22 over right shoulder region 32. The shoulder straps 44 and 46 increase the length of the propagation path of detected RF energy, thereby providing antenna 22 with better efficiency at the lower frequencies, as for example, 30–100 MHz.

RF elements 34 and 38, shoulder straps 44 and 46, and shorting strap 42 are made of electrically conductive material such as metal selected from the group that includes copper, nickel, and aluminum. The width S of each shoulder straps 44 and 46 may be about 2.5 cm. In the preferred embodiment, RF elements 34 and 38, shoulder straps 44 and 46, and shorting strap 42 are made of an electrically conductive and very flexible mesh structure that includes woven copper, or copper coated fabric. If formed as a mesh, the mesh spacing should be less than about 0.1λ, where λ represents the shortest wavelength of the radio frequency signal that is to be detected or transmitted by antenna 21. For example, at a frequency of 500 MHz, 0.1λ=6 cm. One type of suitable, electrically conductive mesh structure from which RF elements 34 and 38, shoulder straps 44 and 46, and shorting strap 42 may be made is Flectron®, which is available from Applied Performance Materials, Inc. of St. Louis. The mesh size of Flectron is much less than 0.1λ for a frequency less than 500 MHz. A further characteristic of Flectron® is that it is breathable. Breathability is a very desirable characteristic for RF elements 34 and 38, shoulder straps 44 and 46, and shorting strap 42 to facilitate dissipation of heat and moisture generated by wearer 25. However, the invention may be practiced wherein any or all of RF elements 34 and 38, shoulder straps 44 and 46, and shorting strap 42 may be made with electrically conductive structures that are not breathable. Also, shoulder straps 44 and 46 overlap and may be sewn to RF element 34 in order to provide excellent electrical conductivity between RF element 34 and shoulder straps 44 and 46.

Referring now to FIG. 3, a flexible, electrically conductive patch 50 is sewn and/or bonded to the bottom center area portion of RF element 34 on the dorsal side 23 of garment 22. Also a flexible, electrically conductive patch 52 is sewn and/or bonded to the top center area of RF element 38 on the dorsal side of 23 of garment 22. The patches 50 and 52 are separated by gap 40. RF feed 54 is electrically connected to impedance matching circuit 57, which in turn is electrically connected to patch 50 by soldering or other conventionally known methods for electrically connecting a wire to another electrically conductive structure. Impedance matching circuit 57 is used to finely match the impedance of antenna 21 with an external load, not shown, and the impedance of the wearer 25. A ground feed 56 is electrically coupled to patch 52 by soldering or other means. Patches 50 and 52 provide a generally heat resistive buffer so that impedance matching circuit 57 and ground feed 56 may be soldered to antenna 21 without causing heat damage that would otherwise result if RF feed 54 and ground feed 56 were directly soldered to RF elements 34 and 38 in applications wherein the latter are made of Flectron®. It is to be understood that RF feed 54 and ground feed 56 are RF isolated from each other. By way of example, patches 50 and 52 may be made of electrically conductive copper foil tape such as 3M Scotch Tape, Model No. 1181.

Figure 4:
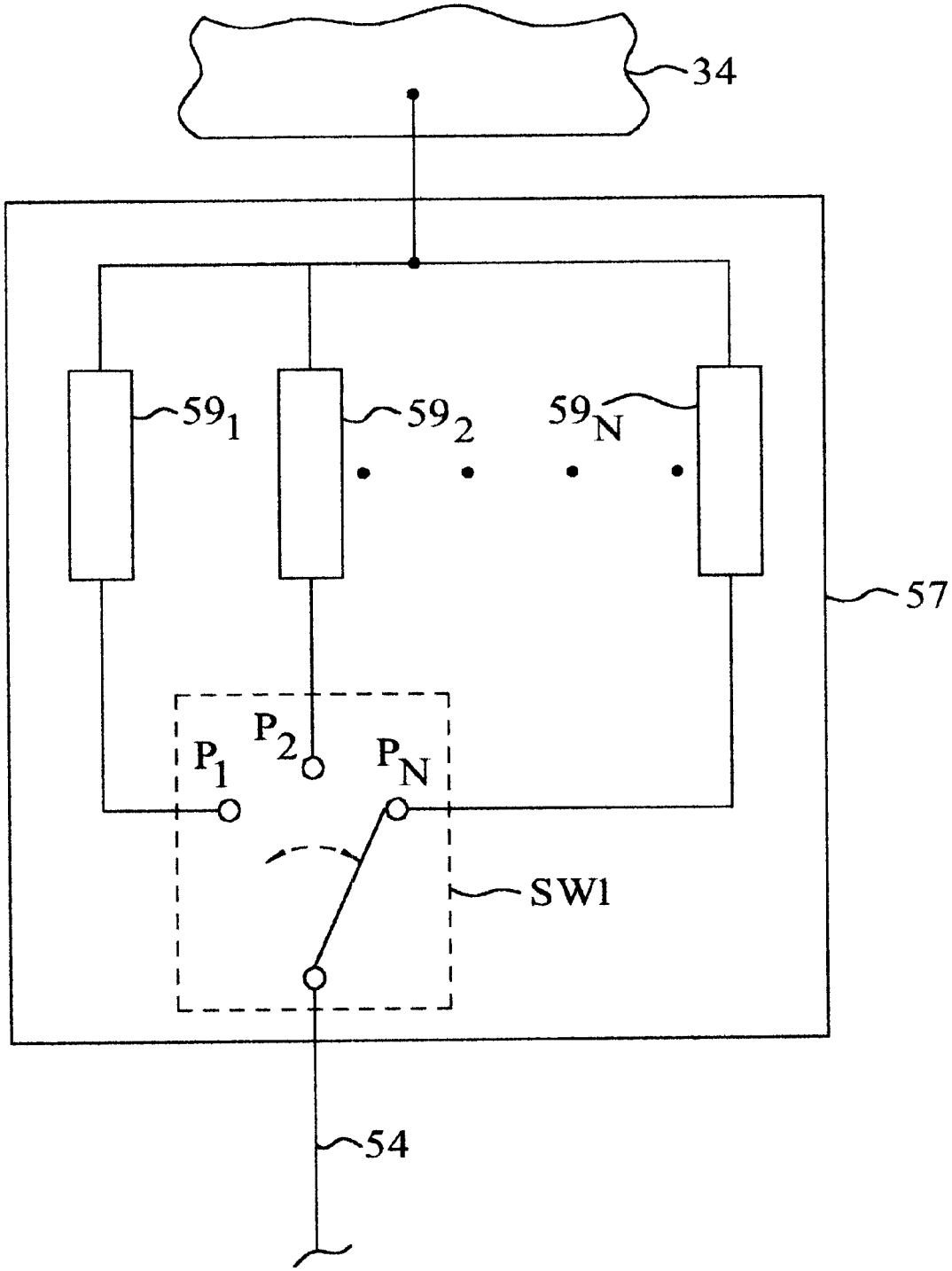
FIG. 4 represents a matching circuit that is incorporated into the antenna.

Referring to FIG. 4, impedance matching circuit is shown, by way of example, to include a switch SW1 having an N number of pole positions $P_1, \ldots P_N$ which selectively receive RF energy via RF feed 54, depending on the state of switch SW1, where N is a positive integer. Poles $P_1 \ldots P_{nN}$ are electrically connected to sub-circuits $\mathbf{59}_1$, $\mathbf{59}_2$, $\mathbf{59}_N$, respectively. FIG. 4 shows by way of illustration only that impedance matching circuit 57 may include more than two sub-circuits $\mathbf{59}_x$, where X represents a positive integer and 1≦X≦N. However, it is to be understood that impedance matching circuit 57 may include one or more sub-circuits $\mathbf{59}_x$. Further, each of sub-circuits $\mathbf{59}_x$ may include elements such as capacitors, resistors, and inductors.

Figure 5:
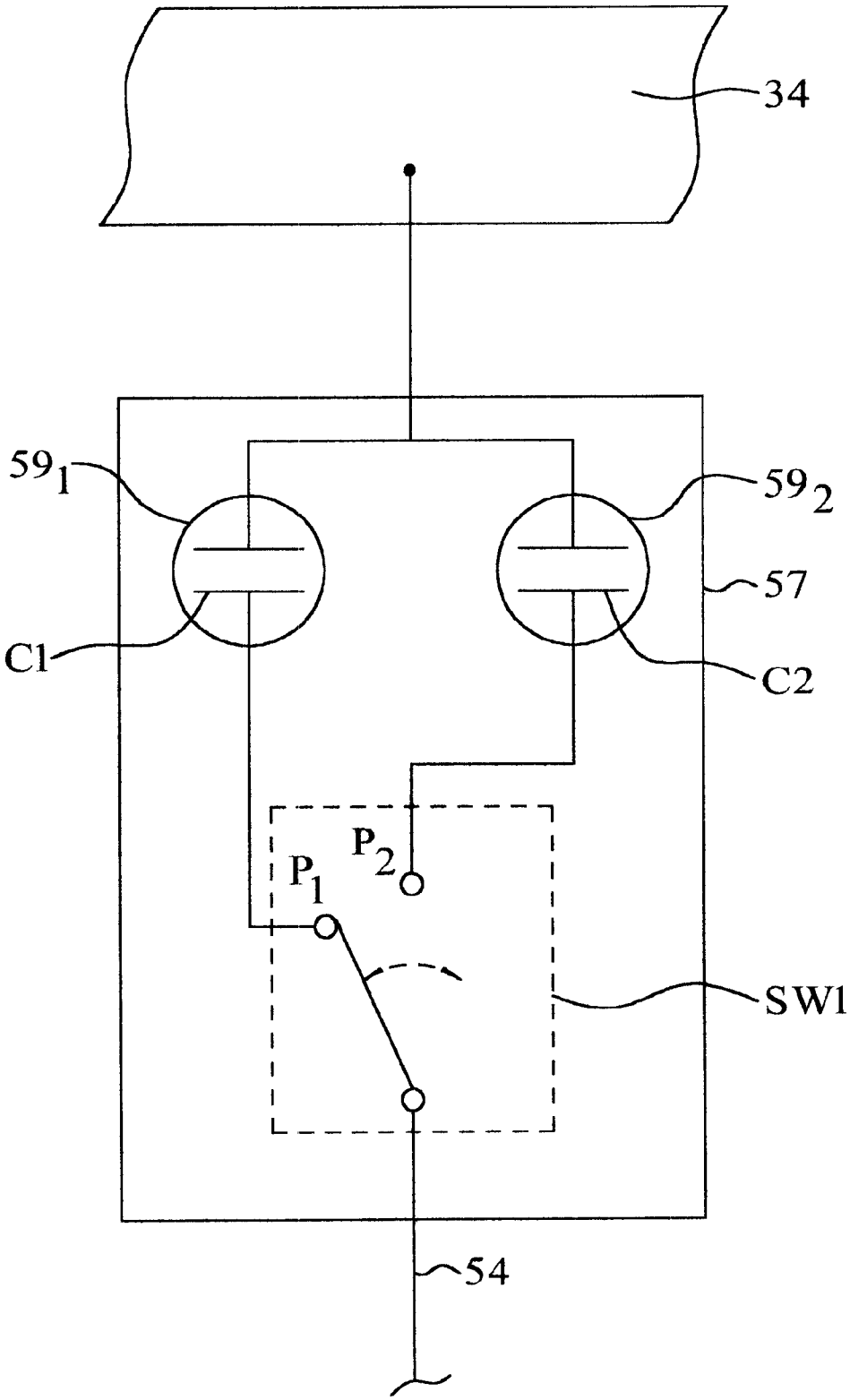
FIG. 5 is a particular implementation of a matching circuit having an N pole switch, where N=2.
Figure 6:
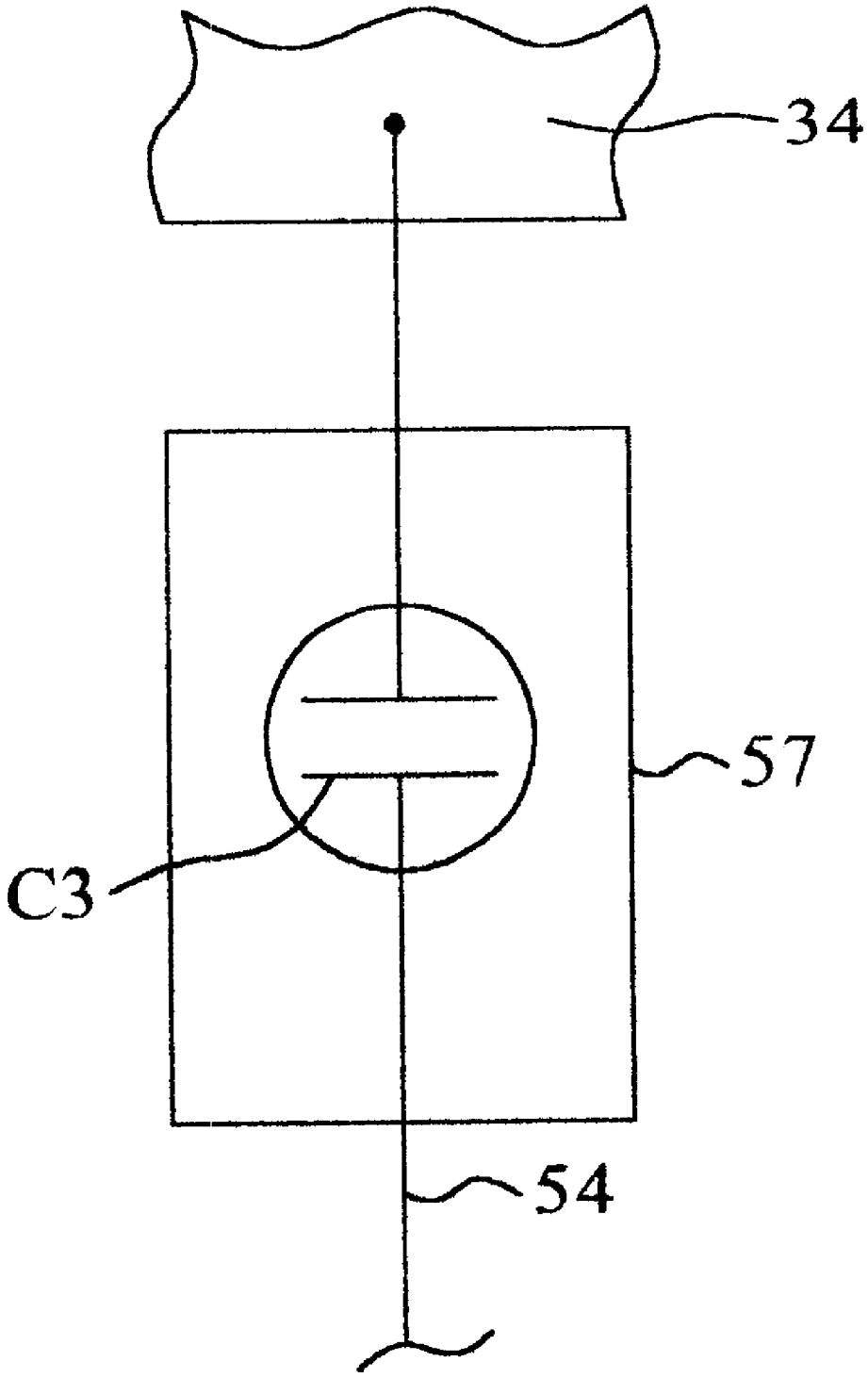
FIG. 6 shows a matching circuit that only includes a capacitor.
Figure 7:
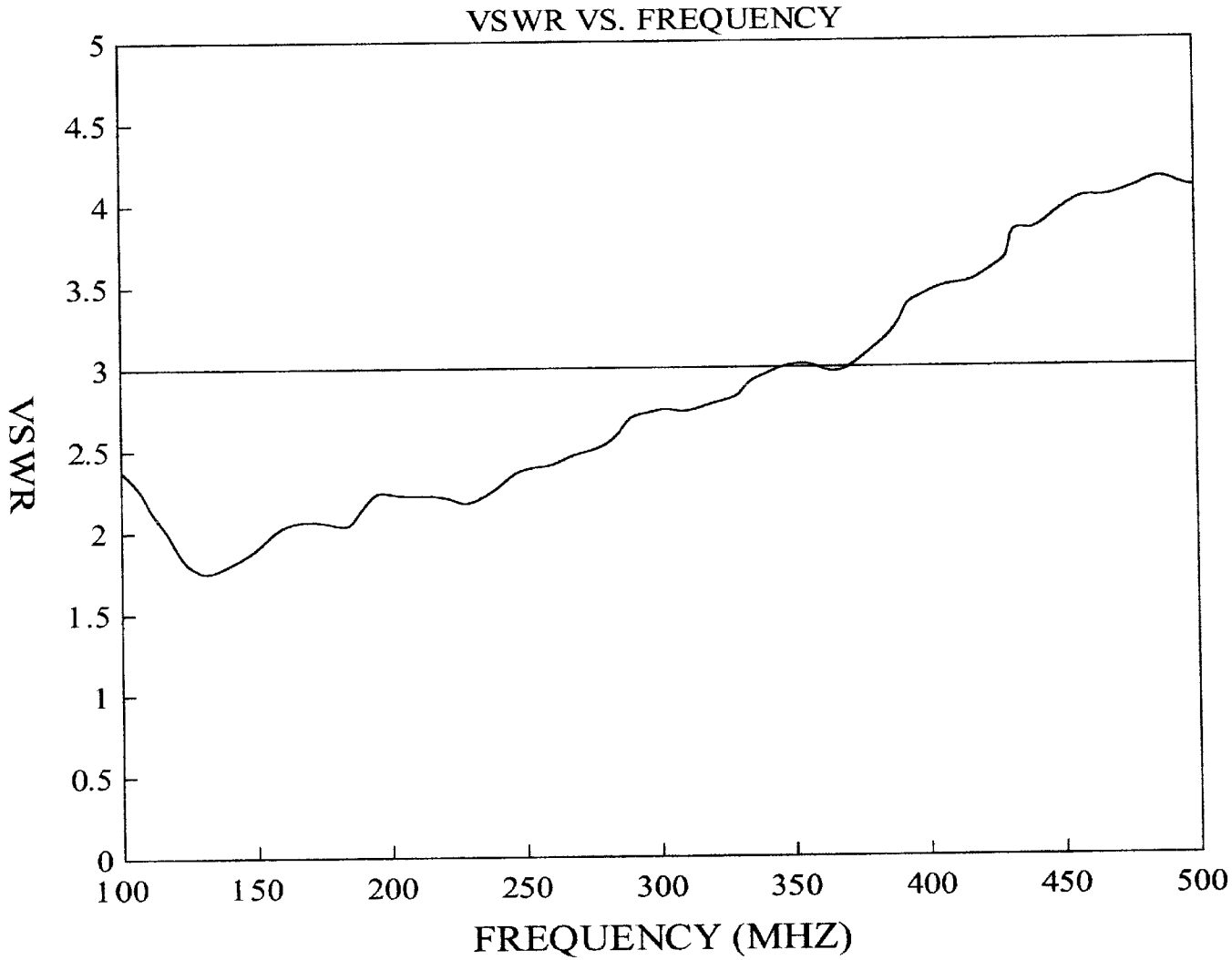
FIG. 7 shows the VSWR performance of the antenna of FIG. 1 over a frequency range of 100 to 500 MHz when a first impedance sub-circuit of the matching circuit is selected.
Figure 8:
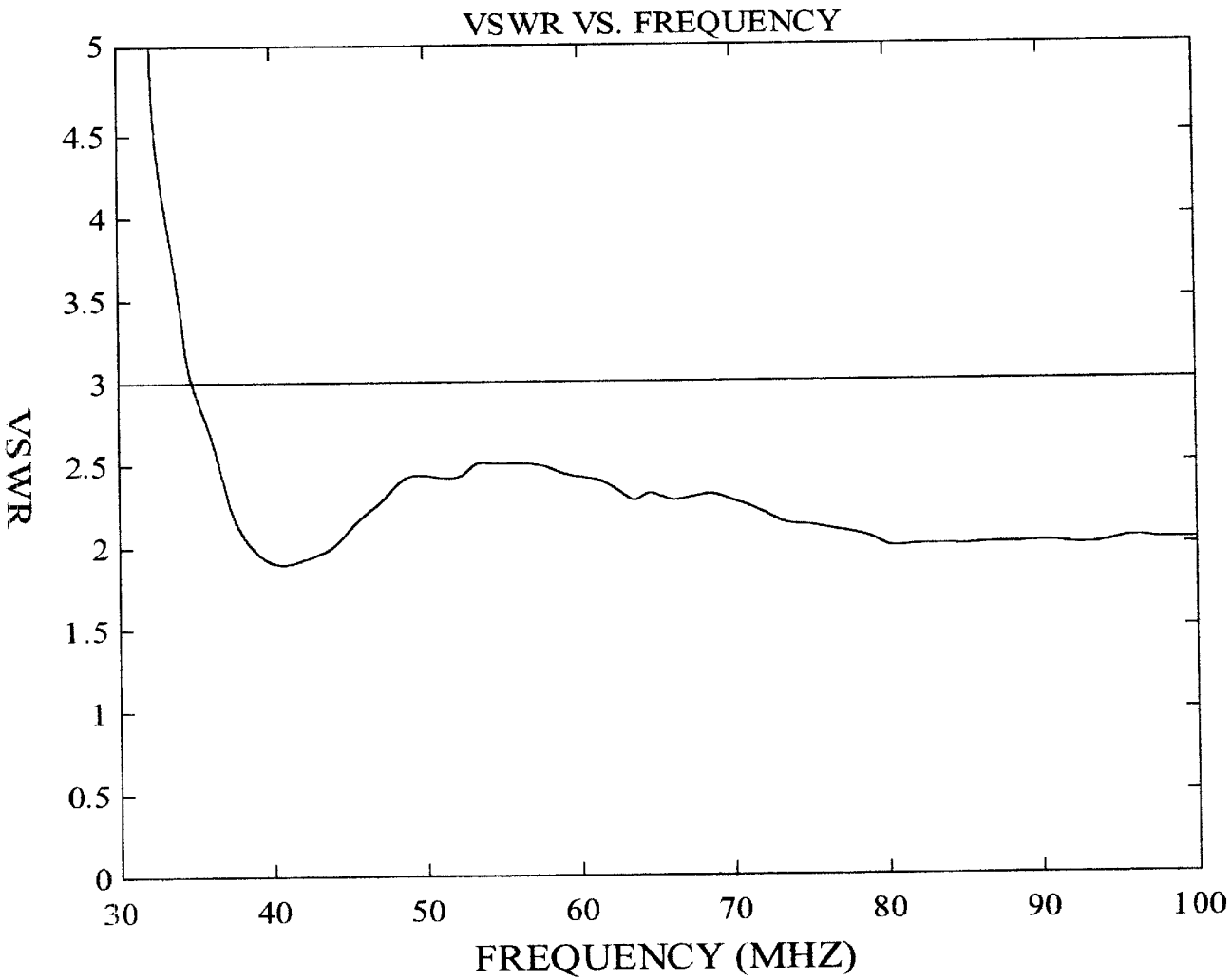
FIG. 8 shows the VSWR performance of the antenna of FIG. 1 over a frequency range of 30 to 100 MHz when a second impedance sub-circuit of the matching circuit is selected.

A particular implementation of impedance matching circuit 57 is shown, by way of example only, in FIG. 5. Impedance matching circuit 57 has a-switch SW1 with poles $P_1$ and $P_2$, and two sub-circuits $\mathbf{59}_1$ and $\mathbf{59}_2$ that are implemented as capacitors C1 and C2. Poles capacitors C1 and C2 are electrically connected to RF element 34. If pole $P_2$ is selected, RF energy is provided to capacitor C2, which may have a capacitance of 24 pf for optimally matching the impedance of antenna 21 over a frequency range of 100–500 MHz. FIG. 7 shows that if pole, $P_2$ is selected, antenna 21 operates with a VSWR of 3:1 or less over a frequency range of 100 to 347 MHz, and with a VSWR in the range of 3:1 to 4.5:1 over 347 to 500 MHz. If pole $P_1$ is selected, RF energy is provided to capacitor C1, which may have a capacitance of 68 pf for optimally matching the impedance of antenna 21 over a frequency range of about 30–100 MHz. FIG. 8 shows that antenna 21 operates with a VSWR of 3:1 or less over 35–100 MHz. In another embodiment of the antenna 21, as shown in FIG. 6, matching circuit 57 may be implemented as a capacitor C3 electrically connected in series between RF feed 54 and first RF element 37. By way of example, capacitor C3 may have a capacitance of about 56 pf. It is to be appreciated that as shown in FIGS. 7 and 8, implementation of matching circuit 57 with multiple, and selectively switchable sub-circuits $\mathbf{59}_x$ generally provides antenna 21 with a better VSWR throughout most of the operating band than when only one sub-circuit $\mathbf{59}_x$ is used. However, the use of only one sub-circuit $\mathbf{59}_x$ provides antenna 21 with enhanced reliability compared to implementations of matching circuit 57 having multiple sub-circuits $\mathbf{59}_x$. Also, the use of only one sub-circuit $\mathbf{59}_x$ avoids isolation issues that may arise between multiple sub-circuits $\mathbf{59}_x$.

Shorting strap 42 is used to match the approximate impedance of antenna 21 with a device (not shown), such as a transmitter, transceiver, or receiver, that may be electrically coupled to RF feed 54 and ground feed 56. Shorting strap 42 may be positioned on the anterior region 26 of the anterior side of garment 22 so that it is generally opposite the locations of the RF feed 52 and ground feed 56. However, it is to be understood that the scope of the invention includes positioning shorting strap 42 on the right anterior side 28 so that it is generally opposite the locations of the RF feed 54 and ground feed 56, as required to suit the needs of a particular application. Changing the position of shorting strap 42 causes the impedance of antenna 21 to vary accordingly. Therefore, the optimal position of shorting strap 42 typically is empirically determined for a particular application that is tailored to the impedance characteristics of individual wearer 25 and the devices that may be electrically connected to antenna 21.

Figure 9:
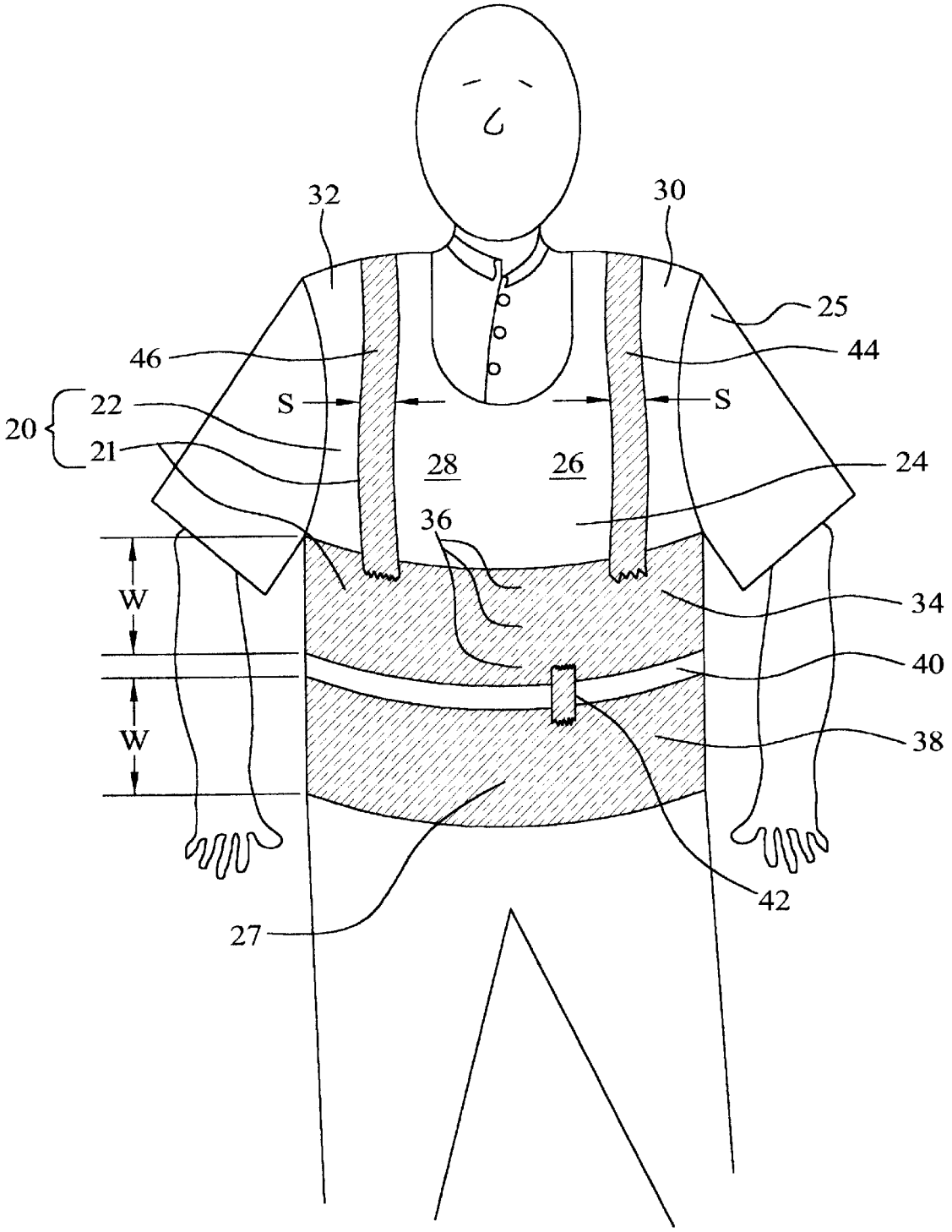
FIG. 9 shows another implementation of the antenna garment wherein the garment is a pullover garment that does not require fasteners.

In another implementation of antenna garment 20, garment 22 may be a pullover garment as shown in FIG. 9 that does not require any snaps or other electrically conductive fasteners to close garment 22 so that RF elements 34 and 34 form a band around the wearer 25.

Obviously, many modifications and variations of the present invention are possible in light of the above teachings. It is therefore to be understood that within the scope of the appended claims, the invention may be practiced otherwise than as specifically described.

We claim:

1. An antenna garment to be worn by a wearer, comprising:

an electrically nonconductive garment having anterior and dorsal regions, and first and second shoulder regions;

an antenna that includes:

a first RF element attached to said garment;

a second RF element attached to said garment so that a gap exists between said first and second RF elements;

an RF feed electrically connected to said first RF element for providing RF energy to said first RF element;

a ground feed electrically connected to said second RF element;

a first shorting strap that electrically connects said first and second RF elements on said anterior region of said garment;

a first strap electrically connected between said anterior and dorsal regions of said first RF element and which extends over a first shoulder region of said garment;

a second strap electrically connected between said anterior and dorsal regions of said first RF element and which extends over a second shoulder region of said garment; and a matching circuit electrically connected between said first RF element and said RF feed.

2. The antenna garment of claim 1 wherein said first and second RF elements are made of a flexible, electrically conductive material.

3. The antenna garment of claim 2 wherein said flexible electrically conductive material is a woven mesh structure.

4. The antenna garment of claim 1 wherein said first and second RF elements each form a band when said garment is worn by said wearer.

5. The antenna garment of claim 1 wherein said antenna operates with a voltage standing wave ratio of less than 3:1 over a frequency range of 35 through 347 MHz.

6. The antenna garment of claim 1 wherein said matching circuit includes one or more impedance sub-circuits each having a unique impedance, and a switch for selectively enabling one of said one or more impedance sub-circuits.

7. The antenna garment of claim 1 wherein said garment is a vest that includes electrically conductive fasteners for fastening the front of said vest.

8. The antenna garment of claim 1 wherein said garment is one-piece pullover garment.

9. The antenna garment of claim 1 wherein said matching circuit includes a capacitor electrically connected between said RF feed and said first RF element.

10. The antenna garment of claim 5 wherein said antenna operates with a voltage standing wave ratio in the range of 3:1 to 4.5:1 over a frequency range of 347 to 500 MHz.

* * * * *